US005683780A

United States Patent [19]

Rodger et al.

[11] Patent Number: 5,683,780

[45] Date of Patent: Nov. 4, 1997

[54] MODULAR CARPET TILE MAT CONSTRUCTION AND PROCESS OF MAKING SAME

[76] Inventors: Malcolm David Rodger, G - 1275 East 27th Street, North Vancouver, British Columbia, Canada, V7J 1S5; Ian Christian MacLellan, 1285 15th Street, West Vancouver, British Columbia, Canada, V7T 2T6

[21] Appl. No.: 252,448

[22] Filed: Jun. 1, 1994

Related U.S. Application Data

[63] Continuation-in-part of Ser. No. 962,227, Mar. 26, 1993, abandoned.

[51] Int. Cl.[6] ..... B32B 3/02; B32B 3/26

[52] U.S. Cl. ..... 428/95; 428/316.6; 442/66; 442/71; 442/164

[58] Field of Search ..... 428/316.6, 95, 428/288, 290, 246, 247, 252; 442/66, 71, 164

[56] References Cited

U.S. PATENT DOCUMENTS

| | | | |
|---|---|---|---|
| 3,007,205 | 11/1961 | House . | |
| 3,028,279 | 3/1962 | Heberlein . | |
| 3,441,469 | 4/1969 | Blue . | |
| 3,763,858 | 10/1973 | Buese | 428/316.6 |
| 4,062,993 | 12/1977 | Seward . | |
| 4,175,155 | 11/1979 | Biranowski et al. | 428/316.6 |
| 4,258,100 | 3/1981 | Fujitani et al. | 428/316.6 |
| 4,351,872 | 9/1982 | Brosseau et al. | 428/316.6 |
| 4,352,851 | 10/1982 | Heitz et al. | 428/316.6 |
| 4,510,201 | 4/1985 | Takeuchi et al. | 428/316.6 |
| 4,584,232 | 4/1986 | Frank et al. | 428/316.6 |
| 4,621,013 | 11/1986 | Holtrop et al. . | |
| 4,636,424 | 1/1987 | Amemiya et al. | 428/316.6 |
| 4,826,723 | 5/1989 | Brambach | 428/316.6 |

FOREIGN PATENT DOCUMENTS

| | | |
|---|---|---|
| 260864 | 3/1988 | European Pat. Off. . |
| 2582210 | 11/1986 | France . |
| 2601712 | 7/1977 | Germany . |
| 1673921 | 4/1990 | Switzerland . |

*Primary Examiner*—Terrel Morris

*Attorney, Agent, or Firm*—Oyen Wiggs Green & Mutala

[57] ABSTRACT

This invention relates to a novel modular carpet tile mat construction and a process of making same. More particularly, the invention relates to a novel modular carpet tile mat construction which is specifically adapted to hold carpet tiles in a fixed position so that they may be used in combination as a floor mat or a covering for part of a floor area, or a self-contained floor covering. A mat base composed of woven or spun-bonded polyester, nylon or polypropylene fibres comprising: (a) a woven or spun-bonded polyester, nylon or polypropylene fibre mat; (b) a plastic binder enveloping the fibre mat and binding the fibres of the mat together to provide a first side on one side of the plastic-enveloped woven or spun-bonded fibre mat and a second side on an opposite side of the plastic-enveloped woven or spun-bonded fibre mat; (c) a first layer of resilient expanded or foamed polymer or rubber distinct from the plastic binder (b) and adhered to the first side of the plastic-enveloped woven or spun-bonded fibre mat; and (d) a second layer of resilient expanded or foamed polymer or rubber distinct from the plastic binder (b) and adhered to the second side of the plastic-enveloped woven or spun-bonded fibre mat.

5 Claims, 2 Drawing Sheets

MODULAR CARPET TILE MAT CONSTRUCTION AND PROCESS OF MAKING SAME

This application is a continuation-in-part of application Ser. No. 07/962,227, filed Mar. 26, 1993, which is abandoned.

FIELD OF THE INVENTION

This invention relates to a novel modular carpet tile mat or self-contained floor covering and a process of making same. More particularly, this invention relates to a novel modular carpet tile mat construction which holds carpet tiles together in a fixed position so that the assembly may be used as a mat or carpet for floor covering and floor sign purposes.

BACKGROUND OF THE INVENTION

Carpet tiles have recently become popular as a floor covering material. They offer many advantages over standard roll-type carpet floor covering. The tiles, which are approximately 0.5 meters (18 inches) square, can be laid over a floor or other area in a mosaic or grid pattern and can easily be individually removed for cleaning or replacement purposes, when individual tiles become soiled or worn. A complete or partial floor covering of carpet tiles is generally inexpensive over time because only the worn or soiled carpet tiles need be removed. The remaining unworn or unsoiled portion of the carpet may be saved and kept in place. This is unlike conventional roll carpet flooring.

Carpet tile also provides more flexibility in carpet design since tiles may be swiftly replaced with a different colour to suit a particular occasion. Reversible carpet tiles of a different colour on the reverse side are also used. Recently, it has been possible to create custom designs and signs on individual carpet tiles or a combination of tiles further expanding their creative possibilities.

In the past, carpet tile has only been used for wall-to-wall floor covering similar to wall-to-wall carpeting. Complete wall-to-wall placement of the carpet tiles was necessary because lateral support is needed to hold the tiles adjacent one another on the floor in the grid pattern and prevent tile slippage. This support has been provided by the wall base.

Restriction of carpet tiles to wall-to-wall use has precluded the use of carpet tiles as floor mats or rugs or as self-contained floor covering. There are many situations where a full wall-to-wall carpeting is not required or desired. In hospitals, for example, because of heavy traffic of heavy rolling stock, large carpeted areas in hallways and rooms are to be avoided. Carpets increase friction and have problems such as carpet wrinkling. Certain entrance areas, though, do require mats for safety and foot cleaning purposes. Often the space to be covered by the mat is an irregular shape and cannot be satisfactorily covered with a standard size and shape mat.

Carpet tiles also have the capability of being custom made so that a unique design may be embedded into the carpeting of each tile or a combination of tiles. This feature suits itself well for uses such as personalized doormats and carpet advertising.

U.S. Pat. No. 3,007,205, House, teaches a bank of foam rubber latex deposited on a revolving belt 10 in front of a rotating doctor roll 15. An open mesh fabric 22 is advanced under tension through the bank of foam so that the fabric 22 enters a central portion of the foamed latex sheet. The foamed latex sheet is then gelled, and finally cured to provide a foamed latex sheet with fabric embedded therein. House, particularly in FIG. 2, discloses a central fabric backbone 22, with sixteen openings per square inch (see column 3, lines 41–42), with a cured and embossed latex foam 23 on opposite sides thereof. House does not disclose a binder. Nor does he disclose a binder which envelops the fabric, before the foam 23 is applied to each side. House simply discloses a structure which is constructed of two elements, namely, a fabric 22, and a cured and embossed latex foam 23 on both sides of the fabric.

U.S. Pat. No. 4,353,944, issued to H. Tarui on Oct. 12, 1982, for an invention entitled "Shoe Scraper Mat", discloses a rubber doormat to be used for scraping outdoor dirt and soil from footwear. Tarui discloses a recessed scraper mat where the edges are higher than the interior. This non-level construction is unsuitable for rolling stock. Tarui does not disclose any modular mat features that would enable the mat to be used in different shapes or sizes. Also his mat is not used in combination with carpet tile as carpet floor covering. Furthermore, Tarui does not disclose an inclined edging that provides a smooth transition from the surrounding floor to the mat so that rolling stock may be safely and smoothly negotiated over the mat.

A difficulty with floor mats composed of carpet tiles is that with heavy traffic, they tend to creep. The force of a pedestrian's foot, or the rolling action of a wheeled carriage, or the like, causes the mat to gradually move along a floor. A new design of floor mat incorporating carpet tiles is required to overcome this problem.

Patent CH-A3-673921, Holzmann, discloses a mat base constructed of woven or spun-bonded polyester, polyamide or polypropylene fibre having a layer of resilient polymer or rubber on one side of the fibres and a layer of resilient polymer or rubber on the opposite side of the fibres. Holzmann does not disclose the use of a binder to bond the fibres together. This patent also does not disclose expanded or foamed polymer or rubber on opposite sides of the fibres and binder.

Patent CH-A-445753 discloses a web-like article constructed of a woven or linear fibre network with expanded or foamed polymer or rubber on one side, or both sides thereof. This patent does not disclose a binder which bonds the fibres together. Moreover, this patent does not pertain to modular carpet tile construction.

Patent FR-A-2582210, Shillito et al., discloses a modular carpet tile mat comprising a single component mat base, a mat frame and a plurality of carpet tiles held by the mat frame. The mat is unitary in construction and comprises a single non-woven mat 27. This patent does not show a mat which is constructed of woven or spun-bonded fibres, bonded together with a plastic binder, and having expanded or foamed plastic or rubber on each side thereof.

SUMMARY OF THE INVENTION

A mat base composed of woven or spun-bonded polyester, nylon or polypropylene fibres comprising: (a) a woven or spun-bonded polyester, nylon or polypropylene fibre mat; (b) a plastic binder enveloping the fibre mat and binding the fibres of the mat together to provide a first side on one side of the plastic-enveloped woven or spun-bonded fibre mat and a second side on an opposite side of the plastic-enveloped woven or spun-bonded fibre mat; (c) a first layer of resilient expanded or foamed polymer or rubber distinct from the plastic binder (b) and adhered to the first side of the plastic-enveloped woven or spun-bonded fibre mat; and (d) a second layer of resilient expanded or foamed polymer or rubber distinct from the plastic binder (b) and adhered to the second side of the plastic-enveloped woven or spun-bonded fibre mat.

The layers (c) and (d) of the base can be formed of an expanded or foamed polyvinyl chloride resin. The fibres of the base can be woven to provide a dimensionally stable fabric containing the fibres. The fibres can be spun-bonded fibres, which are bonded together. The layers of the base can be formed of a resilient non-skid substance.

A modular carpet tile mat for floor covering purposes comprising: (a) a mat base as described; (b) a mat frame attached to the mat base around the perimeter of the mat base, the mat frame having a flange which receives the mat base and an upright face against which an edge of a carpet tile can be received; and (c) one or more carpet tiles held on the mat base and flange by the upright face of the mat frame.

Components of the tile mat frame can be extruded or injection molded. The mat frame can be constructed so that it has a tapered edge on one side thereof, and the flange is at the opposite side thereof. The upright face of the tile mat can be formed between the tapered edge and the flange of the mat frame. A lip can be formed in the top region of the upright face, the lip extending over the flange.

A ridge can be formed in a bottom surface of the mat frame on a side opposite the upright face, the ridge extending the length of the mat frame and parallel to the edges of the tapered edge and the flange of the mat frame.

The mat frame can be constructed of separate components and adjoining corners of adjacent mat frame components can be bevelled. Adjoining corners of the mat frame can be at right angles and the corners can be reinforced by stabilizers which are affixed to the corners of the mat frame.

The mat frame can have formed therein upper and lower flanges which between them grip the edges of the mat base.

A modular carpet tile mat for floor covering purposes comprising: (a) a mat base composed of woven or spun-bonded polyester, nylon or polypropylene fibres comprising: (i) a woven or spun-bonded polyester, nylon or polypropylene fibre mat; (ii) a plastic binder enveloping the fibre mat and dimensionally binding the mat fibres of the fibre mat together to provide a first side on one side of the plastic-enveloped woven or spun-bonded fibre mat and a second side on an opposite side of the plastic-enveloped woven or spun-bonded fibre mat; (iii) a first layer of resilient expanded or foamed polymer or rubber adhered to the first side of the fibres and binder; and (iv) a second layer of resilient expanded or foamed polymer or rubber adhered to the second side of the fibres and binder; (b) a mat frame attached to the mat base around the perimeter of the mat base; and, (c) one or more carpet tiles held on the mat base by the mat frame.

The polyester, nylon or polypropylene fibre mat can be woven or spun-bonded. The first and second resilient layers of the mat base can be expanded or foamed polyvinyl chloride resin or expanded or foamed rubber.

DRAWINGS

In drawings which illustrate specific embodiments of the modular carpet tile mat and a surface for assembling the components of the mat, but which should not be construed as limiting the scope of the invention in any way:

DETAILED DESCRIPTION OF A SPECIFIC EMBODIMENT OF THE INVENTION

Figure 1:
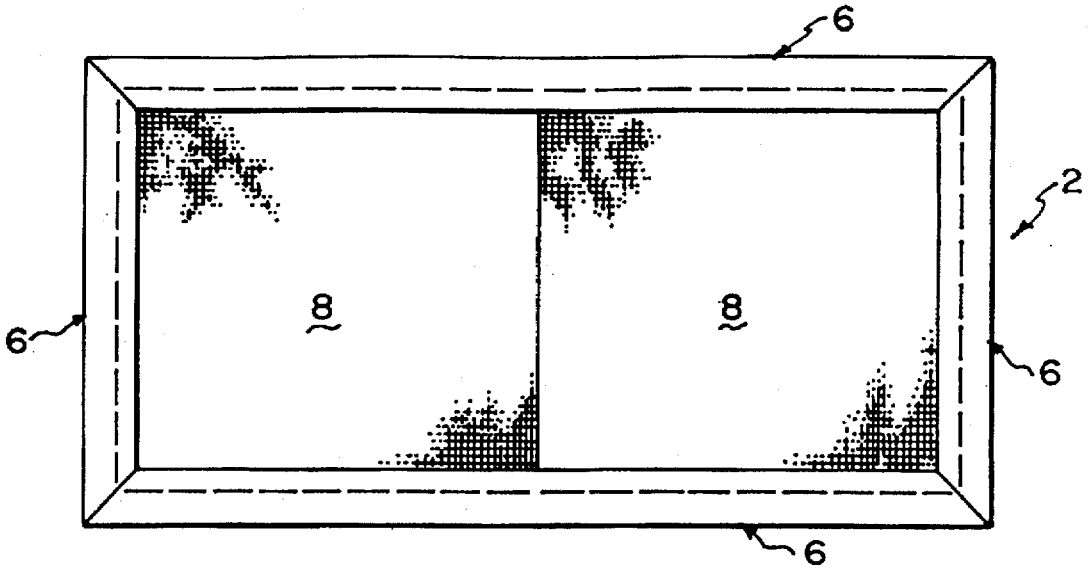
FIG. 1 illustrates a plan view of a floor mat with mat frame and two carpet tiles surrounded by the frame.

We have invented a novel construction of floor mat, adapted to accommodate one or more carpet tiles, and a process for assembling the floor mat combination. Referring to the drawings, FIG. 1 illustrates a plan view of a floor mat 2, which as seen in FIG. 1 has a rectangular shape, constructed of a rectangular frame constructed of four mat frames 6, with bevelled corners, the four assembled mat frame components 6 enclosing two square carpet tiles 8. As can be seen, the two square carpet tiles are held in adjacent position within the four components making up the mat frame 6, to form a tight stable rectangular floor mat 2.

Figure 2:
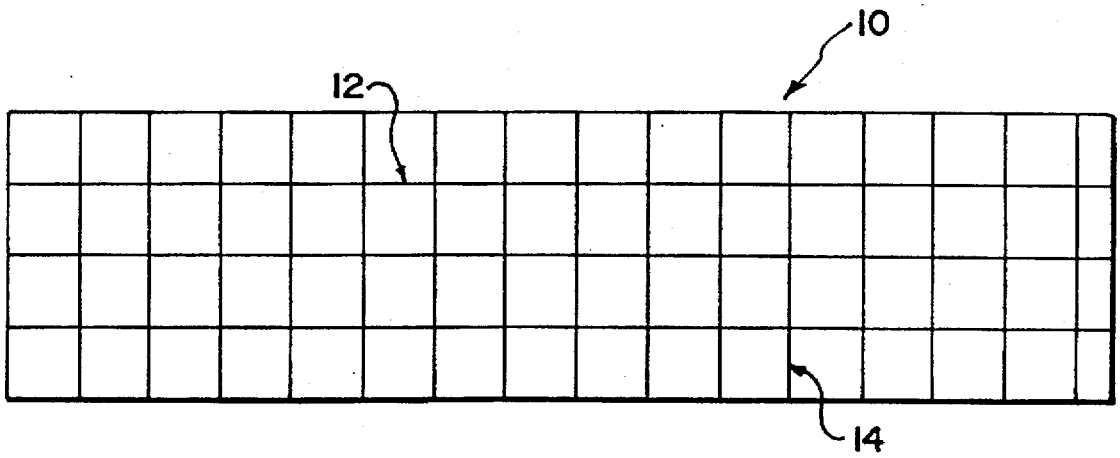
FIG. 2 illustrates a plan view of an assembly table, with grooves arranged in a grid-like pattern, used for assembling a mat base and a mat frame together.

FIG. 2 illustrates a plan view of an assembly table 10, which has formed therein in grid-pattern a series of parallel grooves 12 extending the length of the assembly table 10 and a corresponding parallel series of grooves 14 extending at right angles to grooves 12 across the width of the table 10. The assembly table 10 is used to construct and glue together the components of the floor mat 2, as will be explained later.

Figure 3:
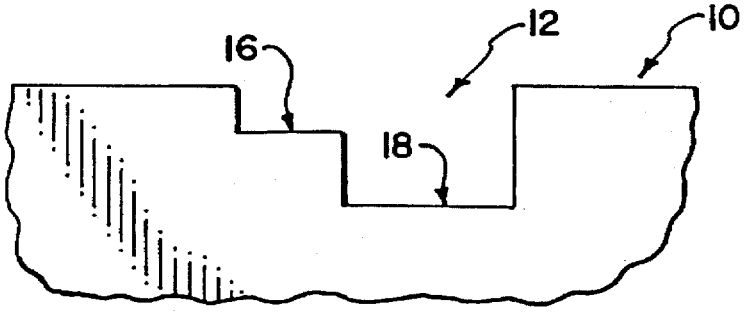
FIG. 3 illustrates an end view of a mat frame groove formed in the surface of the assembly table.

FIG. 3 illustrates an end view of a groove 12, formed in the surface of the assembly table 10. The groove has two depths, a shallow depth and a bottom depth. The shallow depth is in the form of a shelf 16, which is at an elevation higher than the bottom of the groove 18. This configuration is adapted to accommodate the bottom surface shape of a mat frame 6 component.

Figure 4:
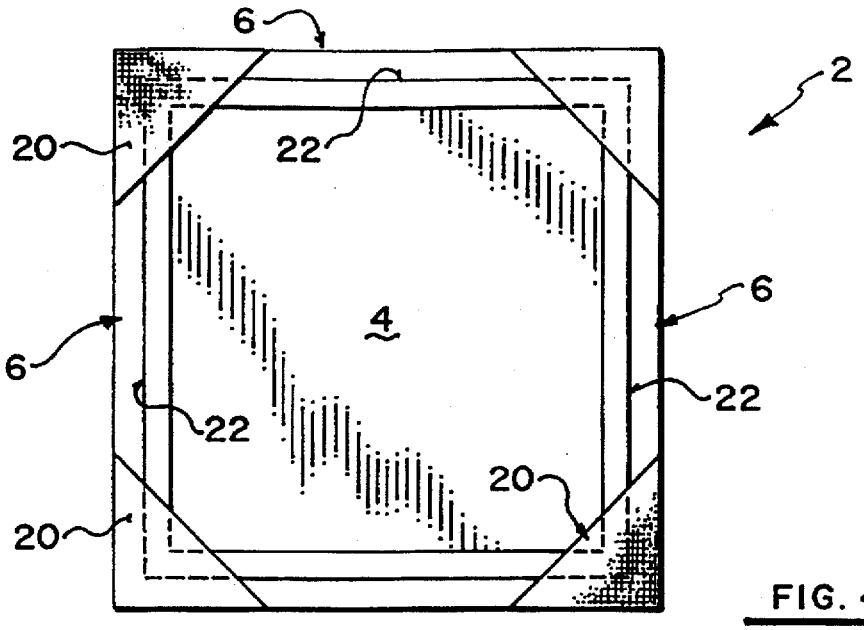
FIG. 4 illustrates a bottom view of a mat base, surrounding mat frame, and corner stabilizers.

FIG. 4 illustrates a bottom view of a floor mat 2, constructed with a square mat base 4, enclosed by four mat frame 6 components, which form a square framing the mat base 4. The four mat frame components 6 have bevelled corners and once assembled, are glued together under pressure using a heat sensitive adhesive. The four mat frame components 6 are assisted in assembly in a square shape by being placed in the appropriate length grooves 12 and width grooves 14 of the assembly table 10. Mat base 4 is then glued by the suitable temperature sensitive adhesive to the interior sections of the mat frame 6. Four triangular shaped corner stabilizers 20 are then glued using the same adhesive at the corners of the floor mat 2. The bottom of the mat frame 6 components has a mid-ridge 22 formed in each component 6. The ridge 22 raises the interior of the frame 6 and persuades the outside edges of the frame 6 to lie flat on the floor.

The mat 4 should be constructed of a dimensionally stable material in order to preserve the orientation of the mat frame. The mat 4 is usually constructed of a woven or spun bonded material such as polyester, polypropylene or nylon fibres, which are held securely together with a resilient binder. Foamed rubber or plastic layers are formed on opposite sides of the fibre-binder combination. The spun bonded fibres are usually secured at the overlapping sections by a suitable adhesive. Knitted materials are not normally used because they do not have dimensional stability.

Figure 5:
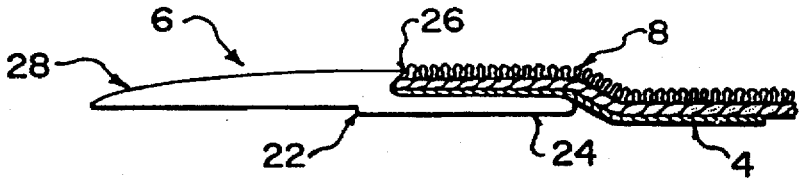
FIG. 5 illustrates a section view of a mat frame component.

FIG. 5 illustrates an end section view of a typical mat frame component 6. The mat frame 6 has formed on one side thereof, extending along the length of the mat frame 6 a lip 26 which protrudes slightly over the mat-flange 24. The bottom surface of the mat frame 6 has a mid-ridge 22 extending along the length of the mat frame 6, approximately midway between each side of the mat frame 6. The ridge 22 raises the centre of the frame 6 and persuades the external edge of the frame to lie flat on a floor. The portion of the mat frame 6 removed from the mat-flange 24 has a taper 28 which is smoothly curved so as to avoid a sharp rough corner or an edge being formed in the exterior edge of the mat frame 6, when the mat frame components are formed into a frame. This taper 28 blends the mat with the floor and enables rolling stock to be readily rolled onto the mat.

Figure 6:
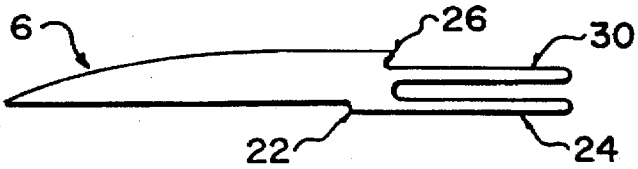
FIG. 6 illustrates a section view of an alternative double flange mat frame component.

FIG. 6 shows in end section view an alternative design of mat frame 6. This design has an upper mat-flange 30, formed above and parallel to the lower mat-flange 24. Otherwise, the alternative design of mat frame is similar to that shown in FIG. 5, namely, a lip 26 protrudes over the flange 24, and a mid-ridge 22 is formed mid-region along the length of the bottom of the mat frame 6.

Figure 7:
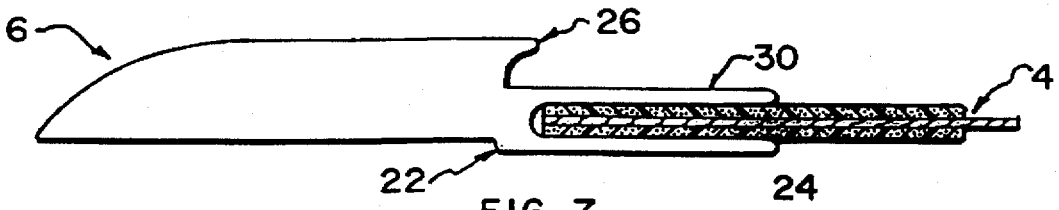
FIG. 7 illustrates a section view of a double flange mat frame component, with a mat base fitting in between the two flanges.

FIG. 7 illustrates, slightly exaggerated for illustrative purposes, an end section view of a mat frame 6, with a mat base 4 inserted between upper mat-flange 30 and lower mat-flange 24. The advantage of the upper mat-flange 30 and the lower mat-flange 24 is that they provide a holding and pinching action on the mat base 4. This forms a strong connection between the mat frame 6 and the mat base 4. The mat base 4 is typically glued on both sides between the upper mat-flange 30 and the lower mat-flange 24 by a suitable temperature sensitive adhesive to form a strong unitary unit.

Figure 8:
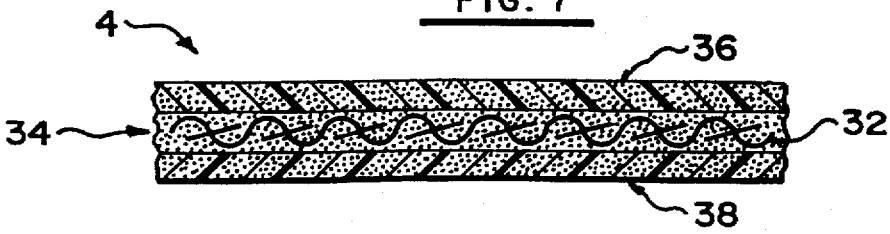
FIG. 8 illustrates a schematic section view of the components making up a mat base.

FIG. 8 illustrates in enlarged schematic end view the construction of a mat base 4, which is very dimensionally stable. A preferred construction of mat base 4 comprises a web of woven or spun bonded polyester, nylon or polypropylene fibres 32, which are completely enveloped and dimensionally bound together by a suitable plastic binder 34. An upper outer resilient layer of expanded or foamed plastic or rubber 36, adheres to the upper side of the plastic binder 34. A lower outer resilient layer of expanded or foamed plastic or rubber 38 adheres to the lower side of the plastic binder 34. The expanded or foamed plastic can typically be expanded polyvinyl chloride resin or rubber. As seen in FIG. 8, as shown by the dotted pattern, the binder 34, which completely encloses and locks the fibres 32, is distinct from the surrounding expanded or foamed upper and lower outer layers 36 and 38, which are indicated with a cross-hatched dotted pattern. The advantage of this design of floor mat 4 is that the woven or spun bonded web of polyester nylon or polypropylene fibres 32, which are locked into place on all sides by the enveloping binder 34, is very dimensionally stable and provides a strong wrinkle resistant, movement resistant reinforcing skeleton for the mat base 4. The expanded plastic layers 36, 38 on both sides of the fibre 32 and binder 34 provides a cushion effect, and also a strong gripping action. The expanded plastic 38 on the bottom of the mat 4 provides a strong gripping action on the floor surface, and resists creep when traffic bears on the floor mat 2. The expanded plastic foam friction surface 36, on the top surface of plastic binder 34, provides a skid free anti-creep gripping action between the top surface of the mat base 4, and the overlying carpet tile 8. The combination of dimensionally stable woven or spun-bonded fibres 32, enveloping binder 34, and outer foamed polymer layers and 38 is unique.

Example

Prototypes have been made of the carpet tile mat utilizing the following components and method.

Floor Mat Components

1. Heat and pressure sensitive glue—Helmiten C2509™ a polyurethane base flexible glue;

2. Mat frame material—A thermoplastic extruded polyurethane with custom profile manufactured on a trial basis by Dow Chemical of Canada Limited;

3. Mat base fabric—Polyvinyl chloride (A/C) expanded foam over elastomer enveloped and bound woven or spun-bonded polyester (or nylon) web (scrim). This non-slip polyvinyl chloride foam is applied to both sides of the web (scrim) fibre-binder combination.

Method of Assembly

1. Assembly table: The product of the invention is made upside down. The right angle grid grooves in the assembly table are cut to a multiple of tile size (457.2 mm) plus a consistent gradation which amounts to about +2 mm every three tiles in both the lengthwise and widthwise directions.

2. Assembly steps: The fabric and nosing are cut to assembly table sizes. The flange, the mat frame pieces and butt face of the mat frame are cut at a 45° mitre and then glued and air dried. The mat base fabric is placed on the table. The triangular and straight fabric braces are then glued and air dried. The "skeleton" of mat frame is placed right side up adjacent to the mat base fabric. The ends (butt faces) of the mat frame are heated with a hot air gun to about 100° C. to reactivate the glue and are then butted together to form a right angle corner. In a rectangle set of grooves on the assembly table, all four comers are joined to form the rectangular skeleton outline of the mat frame. The skeleton, once the glue sets, is inverted onto the mat base fabric and into the right angle grooves in the table. The flanges of the mat frame skeleton, which have glue on them, are is then heated with a hot iron to about 100° C. to reactivate glue on flanges and bond the flange to fabric mat base. The triangle corner braces with glue are then laid on the four corners and heated to about 100° C. to reactivate the glue (using a hot air gun). The finished mat is removed from the table grooves and packed for shipment. The grooves cut into the top of the assembly table ensure the production of square straight and accurate mats, which can receive and hold tile mats which are square cut to very fine tolerances of plus or minus two one-hundredths of an inch.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A modular carpet tile mat for floor covering purposes consisting essentially of:

(a) a mat base consisting essentially of a woven or spun-bonded polyester, nylon or polypropylene fibre mat;

a polymer plastic binder totally immersing the fibre mat so that no fibres are present at the binder surfaces and binding the fibres of the mat together so that the fibres do not move relative to one another to thereby provide a first inelastic polymer plastic binder side on a first side of the binder-immersed woven or spun-bonded fibre mat and a second polymer plastic side on an opposite side of the binder immersed woven or spun-bonded fibre mat, a first layer or resilient expanded or foamed polymer or rubber distinct from said polymer plastic binder and adhered to the binder on the first side of the binder immersed woven or spun-bonded fibre mat, and a second layer of resilient expanded or foamed polymer or rubber distinct from said polymer plastic binder and adhered to the binder on the second side of the binder immersed woven or spun-bonded fibre mat;

(b) a mat frame attached to the mat base around the perimeter of the mat base, the mat frame having a flange which receives the mat base and an upright face with a lip at the top thereof overhanging the flange, against which an edge of a carpet tile can be received; and (c) one or more carpet tiles mechanically held on the mat base and flange by the upright base and lip of the mat frame.

2. A tile mat as claimed in claim 1 wherein the mat frame is constructed so that it has a smoothly tapered edge on one side thereof, and the flange for receiving the mat base is at the opposite side thereof, wherein the upright face and lip abutting the carpet tile and mat base are formed between the tapered edge and the flange of the mat frame.

3. A modular carpet tile mat for floor covering purposes consisting essentially of:

a mat base consisting essentially of a woven or spun-bonded polyester, nylon or polypropylene fibre mat;

a polymer plastic binder totally immersing the fibre mat so that no fibres are present at the binder surfaces and binding the fibres of the mat together so that the fibres do not move relative to one another to thereby provide a first inelastic polymer plastic binder side on a first side of the binder-immersed woven or spun-bonded fibre mat and a second polymer plastic side on an opposite side of the binder immersed woven or spun-bonded fibre mat;

a first layer or resilient expanded or foamed polymer or rubber distinct from said polymer plastic binder and adhered to the binder on the first side of the binder immersed woven or spun-bonded fibre mat; and second layer of resilient expanded or foamed polymer or rubber distinct from said polymer plastic binder and adhered to the binder on the second side of the binder immersed woven or spun-bonded fibre mat;

(b) a mat frame attached to the mat base around the perimeter of the mat base, the mat frame having a flange which receives the mat base and an upright face with a lip at the top thereof overhanging the flange, against which an edge of a carpet tile can be received; and (c) one or more carpet tiles mechanically held on the mat base and flange by the upright base and lip of the mat frame; said mat frame being constructed so that it has a tapered edge on one side thereof, and the flange is at the opposite side thereof and including a ridge formed in a bottom surface of the mat frame on a side opposite the upright face, the ridge extending the length of the mat frame and parallel to the edges of the tapered edge and the flange of the mat frame.

4. A modular carpet tile mat for floor covering purposes consisting essentially of:

(a) a mat base consisting essentially of a woven or spun-bonded polyester, nylon or polypropylene fibre mat;

a polymer plastic binder totally immersing the fibre mat so that no fibres are present at the binder surfaces and binding the fibres of the mat together so that the fibres do not move relative to one another to thereby provide a first inelastic polymer plastic binder side on a first side of the binder-immersed woven or spun-bonded fibre mat and a second polymer plastic side on an opposite side of the binder immersed woven or spun-bonded fibre mat;

a first layer or resilient expanded or foamed polymer or rubber distinct from said polymer plastic binder and adhered to the binder on the first side of the binder immersed woven or spun-bonded fibre mat; and a second layer of resilient expanded or foamed polymer or rubber distinct from said polymer plastic binder and adhered to the binder on the second side of the binder immersed woven or spun-bonded fibre mat;

(b) a mat frame attached to the mat base around the perimeter of the mat base, the mat frame having a flange which receives the mat base and an upright face with a lip at the top thereof overhanging the flange, against which an edge of a carpet tile can be received; and (c) one or more carpet tiles mechanically held on the mat base and flange by the upright base and lip of the mat frame including a lip formed in the top region of the upright face, the lip extending over the flange, wherein adjoining corners of the mat frame are at right angles and the corners are reinformed by stabilizers which are affixed to the corners of the mat frame.

5. A modular carpet tile mat for floor covering purposes consisting essentially of:

(a) a mat base consisting essentially of a woven or spun-bonded polyester, nylon or polypropylene fibre mat;

a polymer plastic binder totally immersing the fibre mat so that no fibres are present at the binder surfaces and binding the fibres of the mat together so that the fibres do not move relative to one another to thereby provide a first inelastic polymer plastic binder side on a first side of the binder-immersed woven or spun-bonded fibre mat and a second polymer plastic side on an opposite side of the binder immersed woven or spun-bonded fibre mat;

a first layer or resilient expanded or foamed polymer or rubber distinct from said polymer plastic binder and adhered to the binder on the first side of the binder immersed woven or spun-bonded fibre mat; and a second layer of resilient expanded or foamed polymer or rubber distinct from said polymer plastic binder and adhered to the binder on the second side of the binder immersed woven or spun-bonded fibre mat;

(b) a mat frame attached to the mat base around the perimeter of the mat base, the mat frame having a flange which receives the mat base and an upright face with a lip at the top thereof overhanging the flange, against which an edge of a carpet tile can be received; and (c) one or more carpet tiles mechanically held on the mat base and flange by the upright base and lip of the mat frame wherein the mat frame has formed therein upper and lower flanges which between them grip the edges of the mat base.

* * * * *